US007503191B2

(12) United States Patent
Knight et al.

(10) Patent No.: US 7,503,191 B2
(45) Date of Patent: Mar. 17, 2009

(54) TUBULAR SLIVER KNIT FABRIC FOR PAINT ROLLER COVERS

(75) Inventors: John C. Knight, Milton, WI (US); Daniel L. Sinykin, Bayside, WI (US)

(73) Assignee: Seamless Technologies, LLC, Janesville, WI (US)

( * ) Notice: Subject to any disclaimer, the term of this patent is extended or adjusted under 35 U.S.C. 154(b) by 0 days.

(21) Appl. No.: 11/740,119

(22) Filed: Apr. 25, 2007

(65) Prior Publication Data

US 2008/0263792 A1 Oct. 30, 2008

(51) Int. Cl.
*D04B 11/08* (2006.01)

(52) U.S. Cl. ..... 66/191; 66/194

(58) Field of Classification Search ..... 66/195, 66/191, 9 R, 10–12, 190, 194; 442/312, 442/313

See application file for complete search history.

(56) References Cited

U.S. PATENT DOCUMENTS

| | | | | | |
|---|---|---|---|---|---|
| 676,668 | A | * | 6/1901 | Patten | 62/74 |
| 1,791,741 | A | | 2/1931 | Moore | |
| 1,849,466 | A | | 3/1932 | Moore | |
| 2,600,955 | A | | 6/1952 | Barnes et al. | |
| 2,630,619 | A | | 3/1953 | Schmidt et al. | |
| 2,704,877 | A | | 3/1955 | Schmidt et al. | |
| 2,737,702 | A | | 3/1956 | Schmidt et al. | |
| 2,752,953 | A | | 7/1956 | Schmidt et al. | |
| 2,920,372 | A | | 6/1960 | Sannipoli et al. | |
| 2,944,588 | A | | 7/1960 | Sannipoli et al. | |
| 3,010,867 | A | | 11/1961 | Sannipoli et al. | |
| 3,181,233 | A | | 5/1965 | Sannipoli et al. | |
| 3,226,952 | A | | 1/1966 | Cassady | |
| 3,299,672 | A | * | 1/1967 | Schmidt | 66/9 R |
| 3,732,135 | A | * | 5/1973 | Erbst et al. | 156/72 |
| 3,853,680 | A | | 12/1974 | Daniel | |
| 3,894,407 | A | | 7/1975 | Clingan et al. | |
| 3,894,409 | A | * | 7/1975 | Clingan et al. | 66/191 |
| 3,896,637 | A | | 7/1975 | Thore | |
| 4,236,286 | A | | 12/1980 | Abler et al. | |
| 4,245,487 | A | * | 1/1981 | Schaab et al. | 66/9 B |
| 4,415,611 | A | * | 11/1983 | Yamagata et al. | 428/15 |
| 4,466,151 | A | * | 8/1984 | Barch et al. | 15/229.13 |
| 4,513,042 | A | * | 4/1985 | Lumb | 428/95 |
| 4,532,780 | A | | 8/1985 | Tilson et al. | |
| 4,546,020 | A | * | 10/1985 | Sakai et al. | 428/16 |
| 4,592,213 | A | | 6/1986 | Tilson et al. | |
| 4,692,975 | A | | 9/1987 | Garcia | |
| 4,798,748 | A | * | 1/1989 | Kitamura et al. | 428/15 |
| 5,206,968 | A | | 5/1993 | Bower et al. | |
| 5,294,276 | A | | 3/1994 | Linn et al. | |

(Continued)

*Primary Examiner*—Danny Worrell
(74) *Attorney, Agent, or Firm*—Reinhart Boerner Van Deuren s.c.

(57) ABSTRACT

A tubular sliver knit fabric is disclosed that is manufactured with the pile extending from the outer side thereof and in an extended length, small diameter configuration, the tubular sliver knit pile fabric subsequently being separable into shorter tubular segments that may be secured to paint roller cover cores to produce seamless paint rollers. The sliver knit paint roller cover fabric of the present invention is manufactured in a tubular segment with the sliver fibers being located on the outside of the tubular sliver knit paint roller cover fabric. The tubular sliver knit paint roller cover fabric of the present invention is also manufactured in a size that makes it appropriate for installation onto paint roller cover cores.

36 Claims, 10 Drawing Sheets

U.S. PATENT DOCUMENTS

| | | | | |
|---|---|---|---|---|
| 5,431,029 | A | | 7/1995 | Kuhrau et al. |
| 5,546,768 | A | | 8/1996 | Kuhrau et al. |
| 5,572,790 | A | | 11/1996 | Sekar |
| 5,577,402 | A | | 11/1996 | Kuhrau et al. |
| RE35,526 | E | | 6/1997 | Alvarez Garcia |
| 5,685,176 | A | | 11/1997 | Kuhrau et al. |
| 5,694,688 | A | | 12/1997 | Musch et al. |
| 6,016,670 | A | | 1/2000 | Kuhrau et al. |
| 6,151,920 | A | * | 11/2000 | Schindler et al. ..... 66/9 R |
| 6,159,320 | A | | 12/2000 | Tams et al. |
| 6,203,648 | B1 | | 3/2001 | Barton et al. |
| 6,324,717 | B1 | | 12/2001 | Sekar |
| 6,502,779 | B1 | | 1/2003 | Jelinek et al. |
| 6,615,490 | B2 | | 9/2003 | Polzin |
| 6,685,121 | B1 | | 2/2004 | Jelinek et al. |
| 6,766,668 | B2 | | 7/2004 | Sinykin |
| 6,902,131 | B1 | | 6/2005 | Jelinek et al. |
| 6,918,552 | B2 | | 7/2005 | Jelinek et al. |
| 6,929,203 | B1 | | 8/2005 | Jelinek et al. |
| 6,993,941 | B2 | * | 2/2006 | Yamaguchi ..... 66/202 |
| 2002/0042331 | A1 | | 4/2002 | Fortner et al. |
| 2002/0091051 | A1 | | 7/2002 | Sekar |
| 2003/0213083 | A1 | | 11/2003 | Yamaguchi |

* cited by examiner

TUBULAR SLIVER KNIT FABRIC FOR PAINT ROLLER COVERS

BACKGROUND OF THE INVENTION

Field of the Invention

The present invention relates generally to sliver knit pile fabrics that may be used to produce paint rollers, and more particularly to a tubular sliver knit pile fabric that is manufactured with the pile extending from the outer side thereof and in an extended length, small diameter configuration, the tubular sliver knit pile fabric subsequently being separable into shorter tubular segments that may be secured to paint roller cover cores to produce seamless paint rollers.

The two inventions which have had the greatest impact on paint application are the invention of the paint roller in the 1930's and the development of water-based paint in the late 1940's. While water-based paints are easy to mix, apply, and clean up, there is little doubt that the paint roller has been the greatest single time saving factor in the paint application process, allowing large surfaces to be painted with a uniform coat of paint quickly and easily. Typically, paint rollers are comprised of two components, namely a handle assembly and a paint roller cover for installation onto the handle assembly.

The handle assembly consists of a grip member having a generally L-shaped metal frame extending therefrom, with the free end of the metal frame having a rotatable support for a paint roller cover mounted thereon. The paint roller cover consists of a thin, hollow cylindrical core which fits upon the rotatable support of the handle, with a plush pile fabric being secured to the outer diameter of the paint roller cover. The core may be made of either cardboard or plastic material, with which material is used for the core generally being determined based upon the selling price of the paint roller cover. The pile fabric is traditionally applied as a strip which is helically wound onto the outer surface of the core with adjacent windings of the fabric strip being located close adjacent each other to provide the appearance of a single continuous pile fabric covering on the core.

Typically, the pile fabric is a dense knitted pile fabric, which may be knitted from natural fibers such as wool or mohair, synthetic fibers such as polyester, acrylic, nylon, or rayon, or from a blend of natural and synthetic fibers. The knitting is typically performed on a circular sliver knitting machine, which produces a tubular knitted base material with a knit-in pile in tubular segments which are approximately fifty-eight inches in circumference by thirty to fifty yards long (depending on fabric weight).

Generally, sliver knitting is a knitting process which locks individual pile fibers directly into a lightweight knit backing or base material in a manner wherein the pile fibers extend from one side of the knit base material. The knit base material itself is made from yarn, which may be knit in a single jersey circular knitting process on a circular knitting machine, with closely packed U-shaped tufts of the fibers being woven into the knit base material which anchors them in the completed pile fabric. The free ends of the fibers extend from one side of the knit base material to provide a deep pile face. The knit base material is typically made of synthetic yarns, with the pile being made of a desired natural or synthetic fiber, or a blend of different fibers.

Such fabrics are illustrated, for example, in U.S. Pat. No. 1,791,741, to Moore, U.S. Pat. No. 2,737,702, to Schmidt et al., U.S. Pat. No. 3,226,952, to Cassady, U.S. Pat. No. 3,853,680, to Daniel, U.S. Pat. No. 3,894,409, to Clingan et al., U.S. Pat. No. 4,236,286, to Abler et al., U.S. Pat. No. 4,513,042, to Lumb, and U.S. Pat. No. 6,766,668, to Sinykin, al of which patents are hereby incorporated herein by reference. Sliver knit high pile fabrics have been widely used for many years in the manufacture of imitation fur fabrics, and also have found use, for example, as linings for overcoats and footwear, as coverings for stuffed toys and floors, in applications in pet beds, case liners, boot and slipper liners, medical pads, and blankets, and, of course, as coverings for paint rollers.

The components of the knitted fabric are a yarn, which is used to knit the fabric's knit base material, and fibers which are supplied in a "sliver" rope, which consists of fibers which are all longitudinally oriented in a rope which is typically less than three inches in diameter. The fibers are loose fibers of either a single type or a uniform blend of multiple types of fibers. The fiber mix will determine the performance, density, texture, weight, patterning, and color of the finished pile fabric.

The fibers are typically blown together in an air chamber to blend them, and then are carded in carding machines that "comb" the fibers to align them in parallel with each other. The fibers are then gathered into a soft, thick rope which is called "sliver" (which is the derivation for the term "sliver knit") or "roving." The yarn and the sliver are supplied to the circular knitting machine, which typically has eighteen heads and produces a tubular knit pile fabric which is approximately fifty-eight inches in circumference. (Thus, when the tubular knit pile fabric is slit longitudinally, the fabric is approximately fifty-eight inches wide.)

Such knitting machines are well known in the art, and are illustrated in U.S. Pat. No. 3,894,407, to Clingan et al., U.S. Pat. No. 3,896,637, to Thore, U.S. Pat. Nos. 4,532,780 and 4,592,213, both to Tilson et al., U.S. Pat. Nos. 5,431,029, 5,546,768, 5,577,402, 5,685,176, and 6,016,670, all to Kukrau et al., and U.S. Pat. No. 6,151,920, to Schindler et al., all of which patents are hereby incorporated herein by reference. Examples of commercial versions of such knitting machines are the Model SK-18 II Sliver Knitter and the Model SK-18J II Sliver Knitter which are available from Mayer Industries, Inc. of Orangeburg, S.C.

The first commercial circular sliver knitting machine had seven heads, and commercially-available circular knitting machines today have between seven and eighteen heads. Eighteen head knitting machines have upwards of one thousand needles, and produce tubular knitted segments that are approximately nineteen inches in diameter (fifty-eight inches in circumference). All of these circular sliver knitting machines produce tubular knitted pile fabric segments having the pile located on the inside. Such circular sliver knitting machines are incapable of either producing tubular knitted pile fabric segments having the pile on the outside or small diameter tubular knitted pile fabric segments.

Following the manufacture of the tubular knitted pile segments on a circular sliver knitting machine, the tubular knitted pile segments are slit longitudinally to produce extended knitted pile segments of fabric which are typically fifty-eight inches wide by thirty to fifty yards long. These extended knitted pile segments of fabric are then tensioned longitudinally and transversely, stretched to a sixty inch width or greater to guarantee the proper number of two and seven-eighth inch strips, and back coated (on the non-pile side of the knit base material) with a stabilized coating composition such as a clear acrylic polymer. The coating composition which is coated onto the non-pile side of the knit base material is then processed, typically by heat, to stabilize the coated, extended knitted pile segment. The heating operation dries and bonds the coating composition to the knit base material, producing a fabric which is essentially lint-free.

The coated, extended knitted pile segment can then be subjected to a shearing operation to achieve a uniform pile length, with the sheared fibers being removed by vacuum, electrostatically, or by any other known removal technique. The pile density, the nap length, and the stiffness of the fibers are varied based upon custom specifications and the particular characteristics of the paint roller cover that are desired.

The sheared, coated, extended knitted pile segment is then slit into a plurality of two and seven-eighths inch wide knitted pile fabric strips, of which there are typically twenty for a sixty inch wide fabric segment. Following this slitting operation, the strips must be vacuumed to remove stray fibers and lint. The knitted pile fabric strips are rolled onto a core to produce twenty rolls of knitted pile fabric strips, each of which is thirty to fifty yards long. These rolls of knitted pile fabric strips may then be shipped to a paint roller cover manufacturer. Alternately, a plurality of standard lengths of the fabric may be seamed together to produce an extended length fabric strip which may be helically wound in consecutive rows upon a core as taught in U.S. Pat. No. 6,502,779, U.S. Pat. No. 6,685,121, U.S. Pat. No. 6,902,131, U.S. Pat. No. 6,918,552, and U.S. Pat. No. 6,929,203, all to Jelinek et al., all of which patents are hereby incorporated herein by reference.

Both the standard length rolls of knitted pile fabric strips and the rolls of extended length knitted pile fabric strips have substantial materials costs and labor costs that are incurred in the manufacturing process after the circular knitting process. The materials costs include the cost of the coating material, losses due to fly (fly are extra fibers that come loose from the knitted pile fabric), losses during the cutting of the sixty inch wide fabric segment into twenty knitted pile fabric strips, and seam losses throughout the operation. The labor costs include the costs to perform the coating process, the brushing, the second pass shearing, and all of the finishing steps within the traditional sliver knit operation including slitting and continuously coiling the fabric slits.

Paint roller covers are manufactured by using a hollow cylindrical core made of cardboard or thermoplastic material which has the knitted pile fabric strip helically wound around the core. During the manufacture of paint rollers, the knitted pile fabric strips are secured to the core either by using adhesive or epoxy, or by thermally bonding the knitted pile fabric strip in place on a thermoplastic core. For examples of these manufacturing processes see U.S. Pat. No. 4,692,975, to Garcia (the "'975 patent"), U.S. Pat. No. 5,572,790, to Sekar (the "'790 patent"), and U.S. Pat. No. 6,159,320, to Tams (the "'320 patent"), each of which are hereby incorporated by reference.

The '975 patent uses a core that is cut from preformed thermoplastic (e.g., polypropylene) tubular stock. The core is mounted on a rotating spindle, and a movable carriage mounted at an angle to the spindle feeds a continuous strip of knitted pile fabric onto the core, with the carriage moving parallel to the spindle in timed relation to its rotation so that the knitted pile fabric strip is wound on the plastic core in a tight helix. Also mounted to the movable carriage is a heat source for heat softening the thermoplastic core just in advance of the point where the knitted pile fabric strip is applied to the thermoplastic core, such that the knitted pile fabric is heat bonded to the thermoplastic core as it is wound thereon. The bond formed between the knitted pile fabric and the thermoplastic core is a strong one not subject to separation from exposure to paint solvents.

The '790 patent uses a core that is formed from a strip (or multiple strips) of thermoplastic material that is (are) helically wound about a stationary mandrill. Alternately, the core may be formed by applying liquefied thermoplastic material to a driven belt which transfers the thermoplastic material to the mandrill. A layer of adhesive is then applied to the outer surface of the core, and the knitted pile fabric strip is applied to the core by helically winding the knitted pile fabric strip onto the core. Alternately, the paint roller may instead be made by bonding, in a single step, a knitted pile fabric strip to a wound strip of thermoplastic material that is wrapped about the mandrill.

The '320 patent extrudes a cylindrical plastic core through a rotating extruder head that is cooled, with the outer surface of the core then being plasma treated. The knitted pile fabric strip is secured onto the plasma treated outer surface of the core by extruding thin films of first and second epoxy resin subcomponents onto the outer surface of the core as it is extruded, cooled, and plasma treated in a continuous process.

Other variations are also known, particularly in technologies relating to manufacturing pile fabric suitable for use on paint rollers. For example, instead of using knitted pile fabric, woven pile fabric can be substituted. Woven pile fabric consists of three yarns—a knit base material or warp yarn, a filling or weft yarn, and a pile yarn. The threads of warp yarn are held taut and in a parallel array on a loom, and the threads of weft yarn are woven across the threads of warp yarn in an over/under sequence orthogonal to the threads of warp yarn, with threads of pile yarn being woven into the weave of warp and weft yarns such that the threads of pile yarn extend essentially perpendicularly from one side of the fabric. Such woven pile fabric may be processed in a manner similar to that described above with regard to the processing of knitted pile segments of fabric to produce strips of woven pile fabric that can be helically wound onto paint roller cover cores.

However, all paint rollers manufactured using the methods described above have a seam. As the strips of fabric are helically wound around the cores, the fabric strips wrap contiguously around the core, thereby creating a helical seam that is located throughout the cover. The seam inevitably produces a less than optimal paint roller cover since a seam can interfere with the uniform application of paint from the paint roller. The helical winding process of manufacturing a paint roller requires careful attention to contiguous winding. Errors resulting in overlapped fabric or gaps in the contiguous winding process often occur, resulting in increased scrap or marketing poor quality covers. Such seams have the potential, particularly with short nap paint rollers, to produce a seam mark or stippling effect on the surface being painted, particularly if the paint being applied combines with the seams to produce a more pronounced defective characteristic in the surface being painted.

An examination of prior technology in the paint roller arts reveals that this problem has been recognized in the past, with several solutions that have been proposed to deal with the challenge presented by the presence of seams in paint roller covers. The first of these, U.S. Pat. No. 2,600,955, to Barnes et al., which patent is hereby incorporated herein by reference, discloses a paint roller cover made from a segment of canvas tubing that has yarn loops sewn therethrough, with the ends of the loops on the outside of the segment of the canvas tubing being cut. This approach is certainly far too expensive to represent a viable solution, and would not compare well to currently commercially available paint roller covers in the quality of the paint coat that could be applied.

Another approach is shown in U.S. Pat. No. 2,920,372, U.S. Pat. No. 2,944,588, and U.S. Pat. No. 3,010,867, all to Sannipoli et al., which patents are hereby incorporated herein by reference, which patents are related and disclose the use of a tubular knitted pile fabric manufactured on an apparatus disclosed in U.S. Pat. No. 1,849,466, to Moore, which patent is hereby incorporated herein by reference. The apparatus disclosed in Moore, which is hand operated, was stated in the Sannipoli et al. patents to be capable of manufacturing a seamless tubular knitted sleeve in which the pile is located on the interior of the sleeve, thereby requiring that the sleeve be inverted prior to mounting it on a core to form a paint roller. As such, the apparatus disclosed in Moore is incapable of manufacturing a knitted sleeve in which the pile is located on the exterior of the sleeve. The Sannipoli et al. patents invert the tubular knitted sleeve by positioning it within a hollow tube and pulling one end of the tubular knitted sleeve around the end of the tube and pushing successive portions of the tubular knitted sleeve along the outside of the tube.

It has been determined that the Sannipoli et al. method has three drawbacks that make it impracticable. The first drawback of the Sannipoli et al. method is that it requires a high degree of manual operation in that it requires cutting of the tubular knitted sleeves to size and placement of the tubular knitted sleeves into the tubes of the inverting machine. The second drawback of the Sannipoli et al. method is that only relatively short length tubular knitted sleeves representing a single paint roller (typically nine inches) can be processed at a time, which makes the method inherently unsuitable for mass production.

The third, and by far the most serious, drawback of the Sannipoli et al. method is that the process of inverting the tubular knitted sleeves inevitably results in stretching the tubular knitted sleeves so that they will not snugly fit on the paint roller cover cores, potentially creating creases in a high percentage of them when they are adhesively secured to the paint roller cover cores. This results in an unacceptably high percentage of them being defective and necessitating them being scrapped, resulting in an unacceptably high scrap cost. Predictably, the method taught in the Sannipoli et al. patents has never found commercial acceptance due to these serious disadvantages.

It is accordingly the primary objective of the present invention that it provide a tubular sliver knit paint roller cover fabric suitable for use in the manufacture of a paint roller cover. It is a related principal objective of the present invention that the sliver knit paint roller cover fabric be manufactured with the pile side facing outwardly rather than inwardly, thereby obviating the need to invert it prior to mounting it on a paint roller cover core. It is an additional related principal objective of the present invention that the sliver knit paint roller cover fabric be of a size suitable for mounting on a paint roller cover core in a seamless manner, without cutting except to a length fitting the length of paint roller cover core material on which the sliver knit paint roller cover fabric is to be mounted.

It is also an objective of the present invention that the sliver knit paint roller cover fabric be suitable for use in its application on a paint roller cover without experiencing any significant degradation of the sliver knit paint roller cover fabric due to its contact with a wide variety of paints, enamels, stains, etc. It is a further objective of the present invention that the sliver knit paint roller cover fabric be manufactured in a manner in which the sliver fibers are securely retained by the knit base material such that the shedding of sliver fibers from the sliver knit paint roller cover fabric is minimized. It is a still further objective of the present invention that the sliver knit paint roller cover fabric be manufacturable in extended length segments that may later be cut to tubular segments of any desired length.

The sliver knit paint roller cover fabric of the present invention must also be of construction which is both durable and long lasting when it has been secured to a paint roller cover core, and the resulting paint roller cover should provide the user with an acceptably long lifetime. In order to enhance the market appeal of the sliver knit paint roller cover fabric of the present invention, it should also be inexpensive to manufacture to thereby afford it the broadest possible market. Finally, it is also an objective that all of the aforesaid advantages and objectives of the sliver knit paint roller cover fabric of the present invention be achieved without incurring any substantial relative disadvantage.

SUMMARY OF THE INVENTION

The disadvantages and limitations of the background art discussed above are overcome by the present invention. With this invention, a sliver knit fabric is provided that has several key characteristics that radically differentiate it from prior sliver knit fabrics. The first and most important of these differentiating factors is that the sliver knit paint roller cover fabric of the present invention is manufactured in a tubular segment with the sliver fibers located on the outside of the tubular sliver knit paint roller cover fabric rather than on the inside, in this manner obviating the need to invert the tubular sliver knit paint roller cover fabric and thereby deform the tubular sliver knit paint roller cover fabric. The second key differentiating factor is that the tubular sliver knit paint roller cover fabric of the present invention is manufactured in a size that makes it appropriate for installation onto paint roller cover cores, which typically have an inner diameter of approximately one and one-half inches (thirty-eight millimeters) and an outer diameter of approximately one and five-eights inches (forty-one millimeters) to one and three-quarters inches (forty-four millimeters).

The tubular sliver knit paint roller cover fabric of the present invention has a knitted base material that is knit in a single jersey circular knitting process on a radically redesigned circular knitting machine that is designed to produce the tubular sliver knit paint roller cover fabric of the present invention. The jersey knitted knit base material of the tubular sliver knit paint roller cover fabric of the present invention has a plurality of courses (which are rows of loops of stitches which run across the tubular sliver knit paint roller cover fabric (around the circumference of the tubular sliver knit paint roller cover fabric)) and a plurality of wales (which are vertical chains of loops in the longitudinal direction of the tubular sliver knit paint roller cover fabric). The number of wales together with the gauge (the number of courses per circumferential inch) determines the diameter of the tubular sliver knit paint roller cover fabric of the present invention. In the tubular sliver knit paint roller cover fabric of the present invention, the number of wales can vary between approximately forty and one hundred wales, with the currently preferred embodiment having approximately fifty-six wales.

The knitting of the stitches of the knit base material is used to anchor tufts of sliver fibers, with the free ends of the tufts of sliver fibers extending from the outer side of the knit base material of the tubular sliver knit paint roller cover fabric of the present invention. As the tubular sliver knit paint roller cover fabric of the present invention is knit, the height of the outermost ends of the tufts of sliver fibers will likely vary somewhat. The fiber length will vary depending upon the desired characteristics of the length of the pile desired in the tubular sliver knit paint roller cover fabric, and will typically vary between approximately three-eighths of an inch (nine and one-half millimeters) and four inches (one hundred two millimeters).

The tubular sliver knit paint roller cover fabric of the present invention may be manufactured in extended lengths, which may be cut to the desired lengths subsequent to its manufacture. Notably, the tubular sliver knit paint roller cover fabric of the present invention does not require inverting since the pile is located on the outside. It will be appreciated by those skilled in the art that the tubular sliver knit paint roller cover fabric of the present invention does not require slitting since it is produced to fit over paint roller cover cores rather than to be wound helically around paint roller cover cores. Thus, all of the post-knitting material and labor costs mentioned above with reference to the manufacture of standard or extended length rolls of knitted pile fabric strips are not incurred in the manufacturing of the tubular sliver knit paint roller cover fabric of the present invention.

The tubular sliver knit paint roller cover fabric of the present invention may be cut to single paint roller length (typically nine inches (two hundred twenty-nine millimeters)), or it may be cut to fit a longer length paint roller cover core segment, such as, for example, sixty-four inches (one thousand six hundred twenty-five millimeters). Following application of the longer length paint roller cover core segment to the longer length paint roller cover core segment, it may be cut into smaller paint roller covers, such as, for example, seven nine inch paint roller covers. Alternately, the extended paint roller cover segments may be manufactured at the same facility manufacturing the tubular sliver knit paint roller fabric, with the extended paint roller cover segments being shipped to a paint roller manufacturer for finishing.

Finishing either the cut-to-length paint roller covers or the extended paint roller cover segment may include combing the sliver knit paint fabric on the paint roller cover and shearing the sliver knit paint fabric on the paint roller cover. These finishing steps may occur either before or after cutting the paint roller covers to the desired length. Finally, the edges of the paint roller covers are beveled, and any loose sliver fibers may be vacuumed off. The finishing of extended paint roller cover segments may be performed using the MBK Maschinenbau GmbH paint roller finishing machine distributed by Roller Fabrics, an Edward Jackson (Engineer) Limited finishing machine, or other equipment custom built by individual paint roller manufacturers.

The tubular sliver knit paint roller cover fabric of the present invention may be mounted onto a paint roller cover core in any desired manner. Different ways of adhering the tubular sliver knit paint roller cover onto a paint roller cover core include the use of adhesives or epoxies, or heating the outer surface of the paint roller cover core to partially melt the outer surface thereof and placing the tubular sliver knit paint roller cover over the partially melted surface to secure it thereupon. The tubular sliver knit paint roller cover fabric of the present invention is suitable for paint roller cover cores made according to any of a variety of ways, including paint roller cover cores that have been molded out of a thermoplastic material or manufactured out of a cardboard material, paint roller cover cores that have been made from helically wound strip(s) of thermoplastic material that is (are) formed around a mandrill, or paint roller cover cores that have been extruded from a rotating extruder head, cooled, and plasma treated.

It may therefore be seen that the present invention provides a tubular sliver knit paint roller cover fabric that is suitable for use in the manufacture of a paint roller cover. The tubular sliver knit paint roller cover fabric of the present invention is manufactured with the pile side facing outwardly rather than inwardly, thereby obviating the need to invert it prior to mounting it on a paint roller cover core. The tubular sliver knit paint roller cover fabric of the present invention is of a size suitable for mounting on a paint roller cover core in a seamless manner, without cutting it except for cutting it to a length fitting the length of paint roller cover core material on which the tubular sliver knit paint roller cover fabric is to be mounted.

The tubular sliver knit paint roller cover fabric of the present invention is well suitable for use in its application on a paint roller cover, and will not experience any significant degradation of the tubular sliver knit paint roller cover fabric due to its contact with a wide variety of paints, enamels, stains, etc. The tubular sliver knit paint roller cover fabric of the present invention is manufactured in a manner in which the sliver fibers are securely retained by the knit base material such that the shedding of sliver fibers from the tubular sliver knit paint roller cover fabric is minimized. The tubular sliver knit paint roller cover fabric of the present invention is also manufacturable in extended length segments that may later be cut to tubular segments of any desired length.

The tubular sliver knit paint roller cover fabric of the present invention is of a construction which is both durable and long lasting when it has been secured to a paint roller cover core, and the resulting paint roller cover will provide the user with an acceptably long lifetime. The tubular sliver knit paint roller cover fabric of the present invention is also inexpensive to manufacture, thereby enhancing its market appeal and to affording it the broadest possible market. Finally, all of the aforesaid advantages and objectives of the tubular sliver knit paint roller cover fabric of the present invention are achieved without incurring any substantial relative disadvantage.

DESCRIPTION OF THE DRAWINGS

These and other advantages of the present invention are best understood with reference to the drawings, in which.

DETAILED DESCRIPTION OF THE PREFERRED EMBODIMENT

Figure 1:
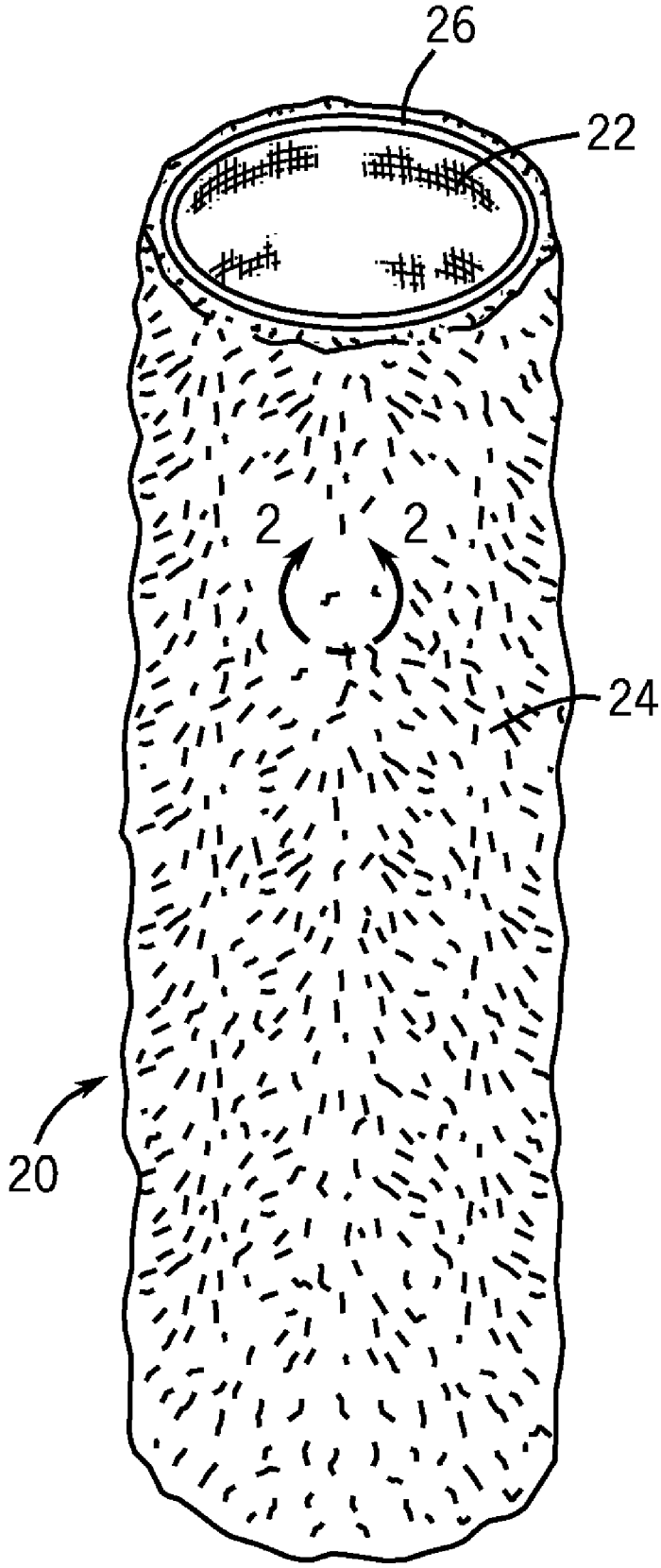
FIG. 1 is an isometric view of a segment of tubular paint roller fabric made according to the teachings of the present invention with the pile extending outwardly, showing a tubular knit base having pile fibers extending outwardly therefrom.

The preferred embodiment of the sliver knit paint roller cover fabric of the present invention produces a tubular sliver knit segment 20 as shown in FIG. 1 that may be continuously knitted in an extended length. The tubular sliver knit segment 20 consists of a lightweight knit backing or base material 22 having pile fibers 24 extending from the knit base material 22 on the outer surface of the tubular sliver knit segment 20. It may be seen from a top edge 26 of the knit base material 22 that the tubular sliver knit segment 20 has an essentially circular cross section. The tubular sliver knit segment 20 may be knitted in as long a length as desired, notwithstanding that FIG. 1 only shows a relatively short segment of the tubular sliver knit segment 20.

Figure 2:
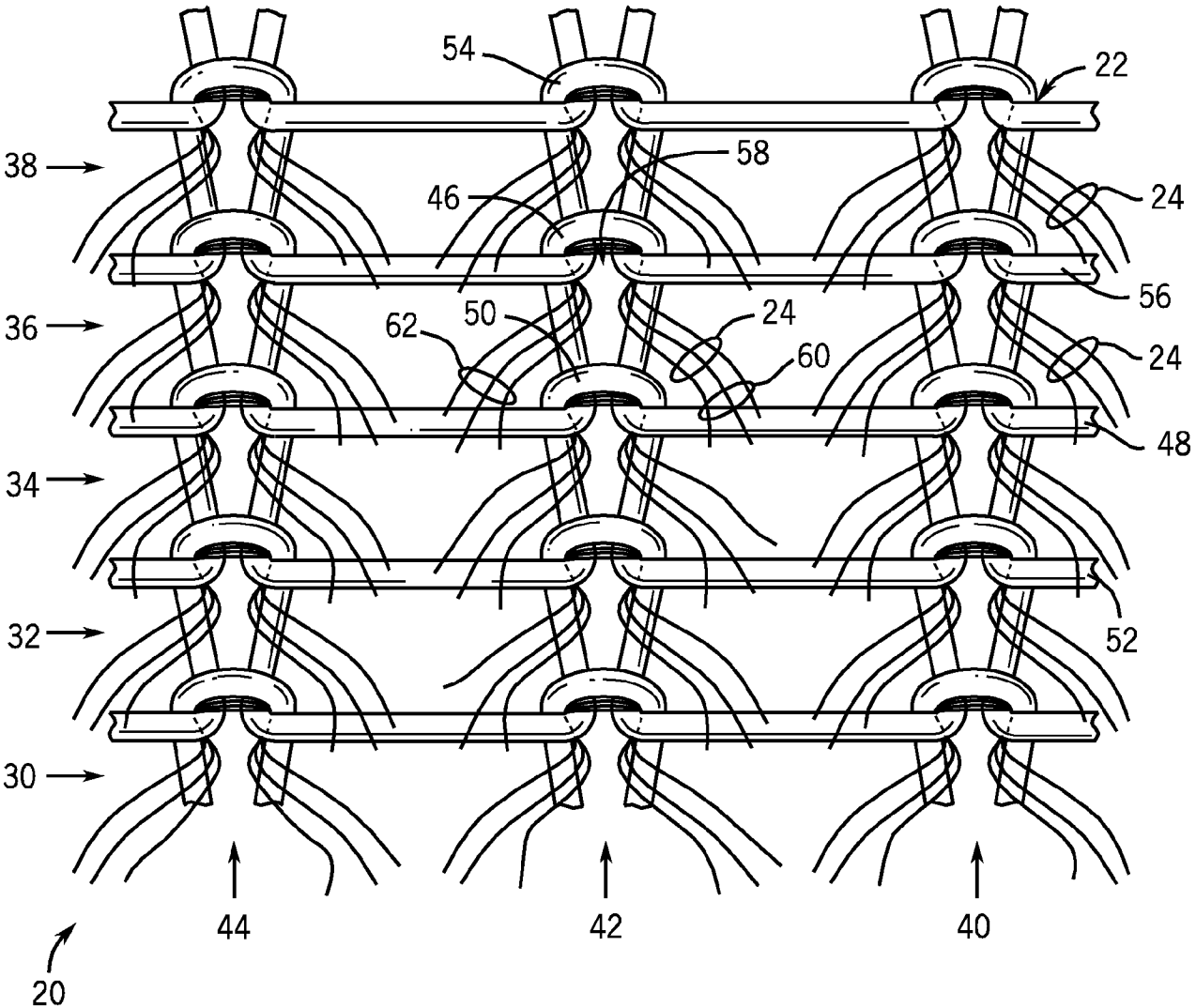
FIG. 2 is a schematic view of a portion of the tubular paint roller fabric illustrated in FIG. 1 from the outside, showing the knitting pattern of the base yarn and the placement of pile fibers from the sliver into the knit base.

Referring next to FIG. 2, a segment of the tubular sliver knit segment 20 is shown in schematic form from the outside thereof to illustrate the knit of the knit base material 22, and the manner in which tufts of the pile fibers 24 are woven into the knit base material 22. Those skilled in the art will at once realize that while the tufts of the pile fibers 24 shown in FIG. 2 include only a few fibers each for added clarity and understanding of the construction of the pile fabric 20, tufts of the pile fibers 24 in the tubular sliver knit segment 20 will actually include sufficient pile fibers 24 to make a pile that is sufficiently dense for the intended use of the tubular sliver knit segment 20 in the manufacture of a paint roller cover.

The foundation of the tubular sliver knit segment 20 is the knit base material 22, which may be knit in a highly modified single jersey circular knitting process on a radically redesigned circular knitting machine. The knit base material 22 has a plurality of courses (which are rows of loops of stitches which run across the knit fabric), five of which are shown and designated by the reference numerals 30, 32, 34, 36, and 38, and a plurality of wales (which are vertical chains of loops in the longitudinal direction of the knit fabric), three of which are shown and designated by the reference numerals 40, 42, and 44. The respective courses 30, 32, 34, 36, and 38 are knitted sequentially from the lowest course number to the highest course number.

By way of example, the construction of the portion of the tubular sliver knit segment 20 in the area of the course 36 and the wale 42 will be discussed herein. A loop 46 formed in a yarn segment 48 is located in this area, with a loop 50 formed in a yarn segment 52 being located in the course 34 below the loop 46, and a loop 54 formed in a yarn segment 56 being located in the course 38 above the loop 46. The loop 46 extends through the loop 50 from the outside to the inside of the tubular sliver knit segment 20 (shown in FIG. 2), and the loop 54 also extends through the loop 46 from the outside to the inside. It will at once be appreciated by those skilled in the art that this arrangement of loops in sequentially knitted courses is completely opposite to the way in which sliver knit fabrics have been knitted on known circular knitting machines.

A tuft of pile fibers 24 having a loop portion 58 and opposite end portions 60 and 62 is knitted into the knit base material 22 together with the loop 46. The loop portion 58 of that particular tuft of pile fibers 24 is located adjacent the top of the loop 46, and the opposite end portions 60 and 62 of that particular tuft of pile fibers 24 extend outwardly from the interior of the loop 46, above the loop 50 and below the loop 54. In a similar manner, each of the other tufts of the pile fibers 24 is knitted into the knit base material 22 with a different loop.

Figure 3:
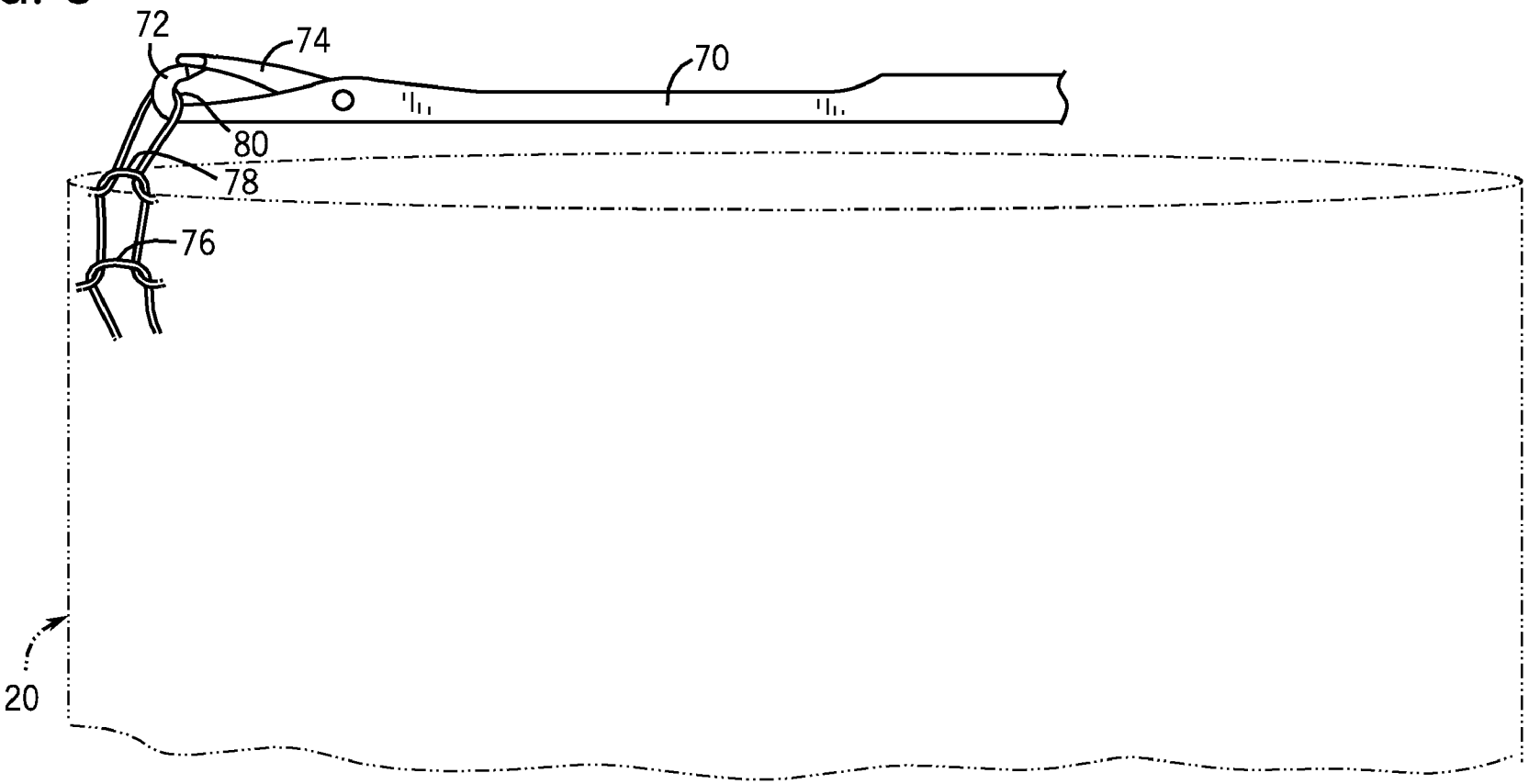
FIG. 3 is a schematic view of a knitting needle having a hook located at the distal end thereof and a latch pivotally mounted at a position proximal from the hook, the knitting needle being used to knit a tubular paint roller fabric similar to the one illustrated in FIGS. 1 and 2, with the needle being in a resting position with regard to an old loop.
Figure 4:
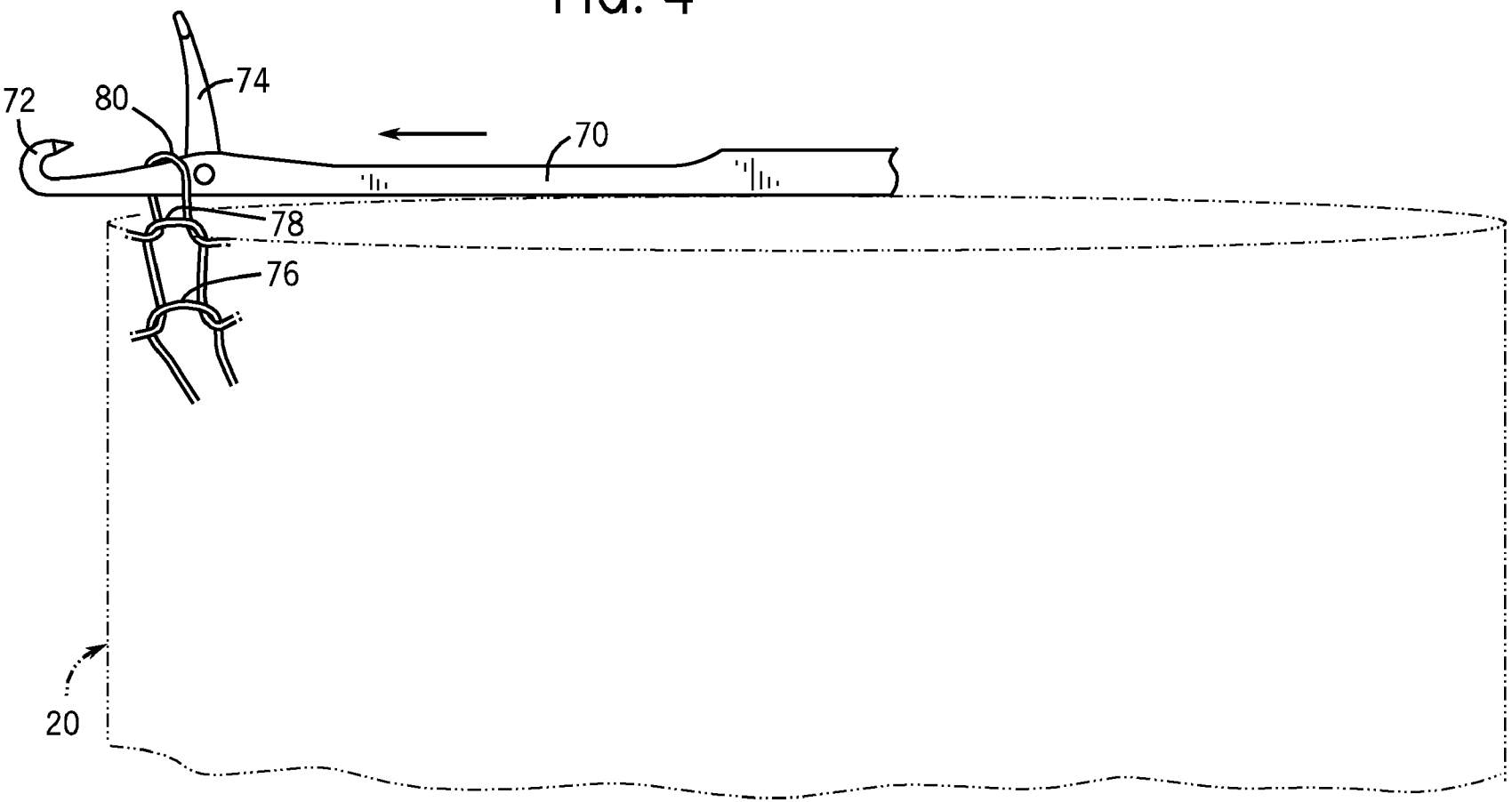
FIG. 4 is a schematic view of the knitting needle and the tubular paint roller fabric shown in FIG. 3, with the needle moving in a distal direction and the old loop opening the latch of the needle.
Figure 5:
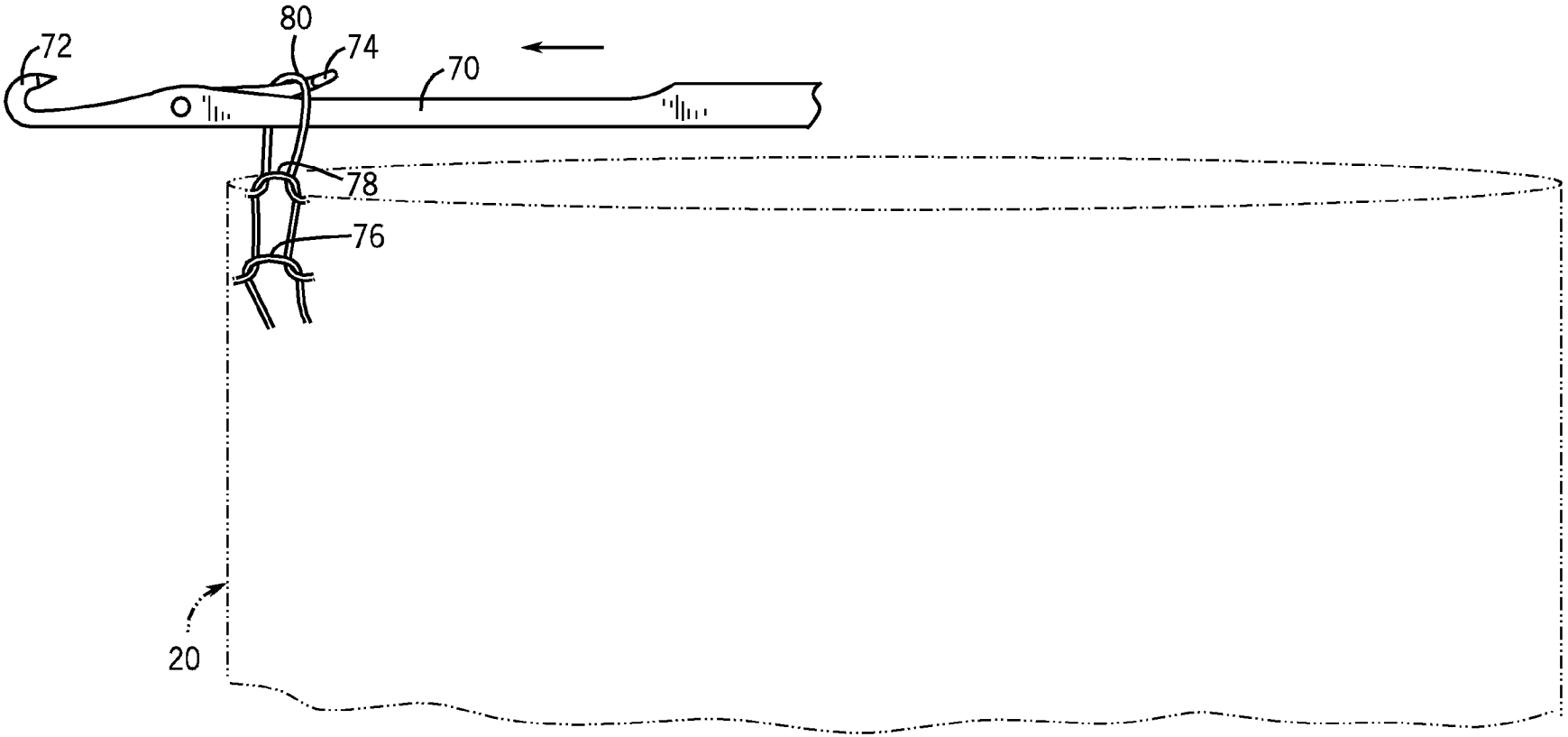
FIG. 5 is a schematic view of the knitting needle and the tubular paint roller fabric shown in FIGS. 3 and 4, with the needle continuing to move in a distal position and the latch being in a tuck position.
Figure 6:
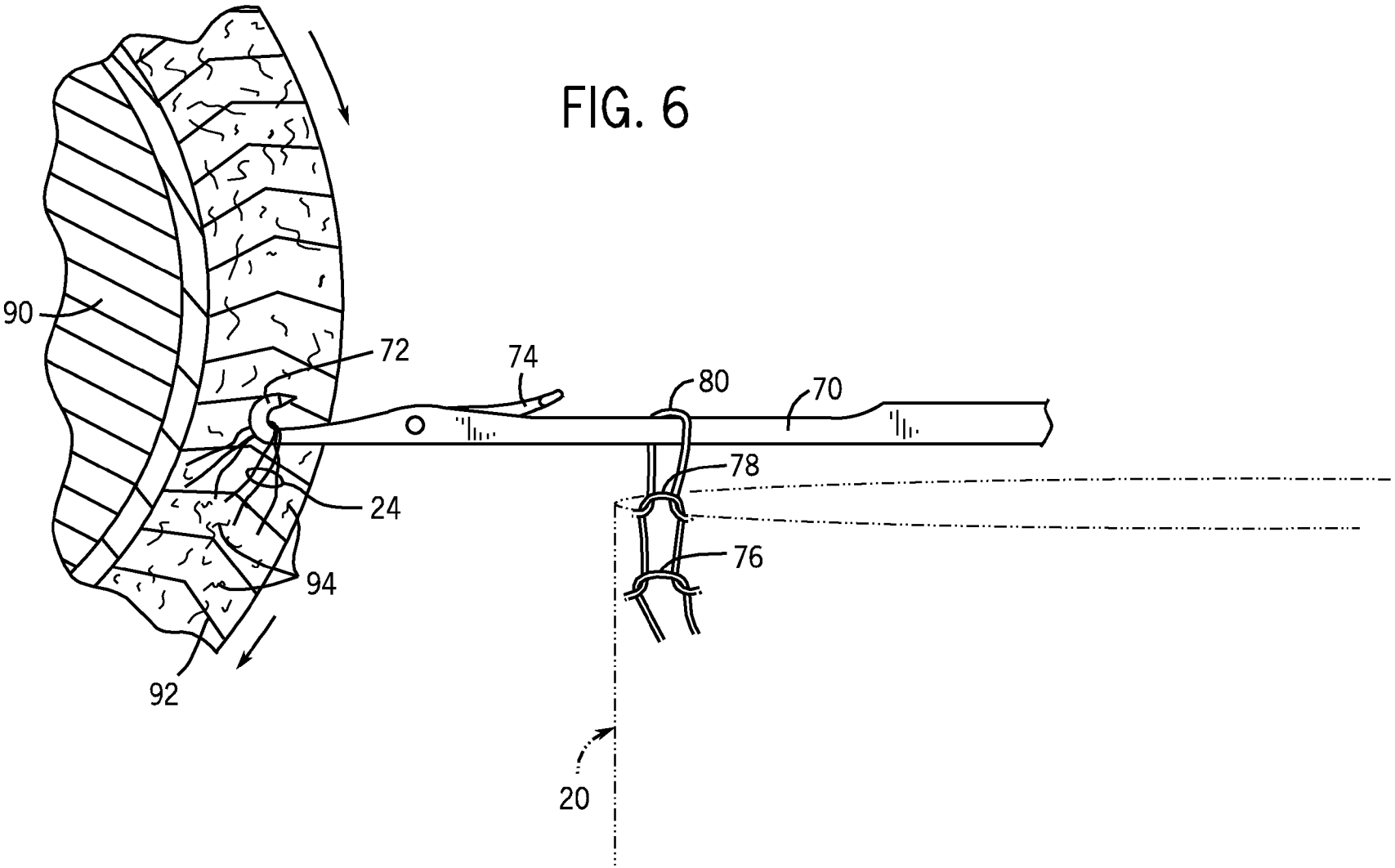
FIG. 6 is a schematic view of the knitting needle and the tubular paint roller fabric shown in FIGS. 3 through 5 and also showing a doffer roll having a wire face with sliver fibers thereon, with the needle being in a doff position (its fully distal position) and sliver fiber from the doffer roll being placed onto the hook of the needle.
Figure 7:
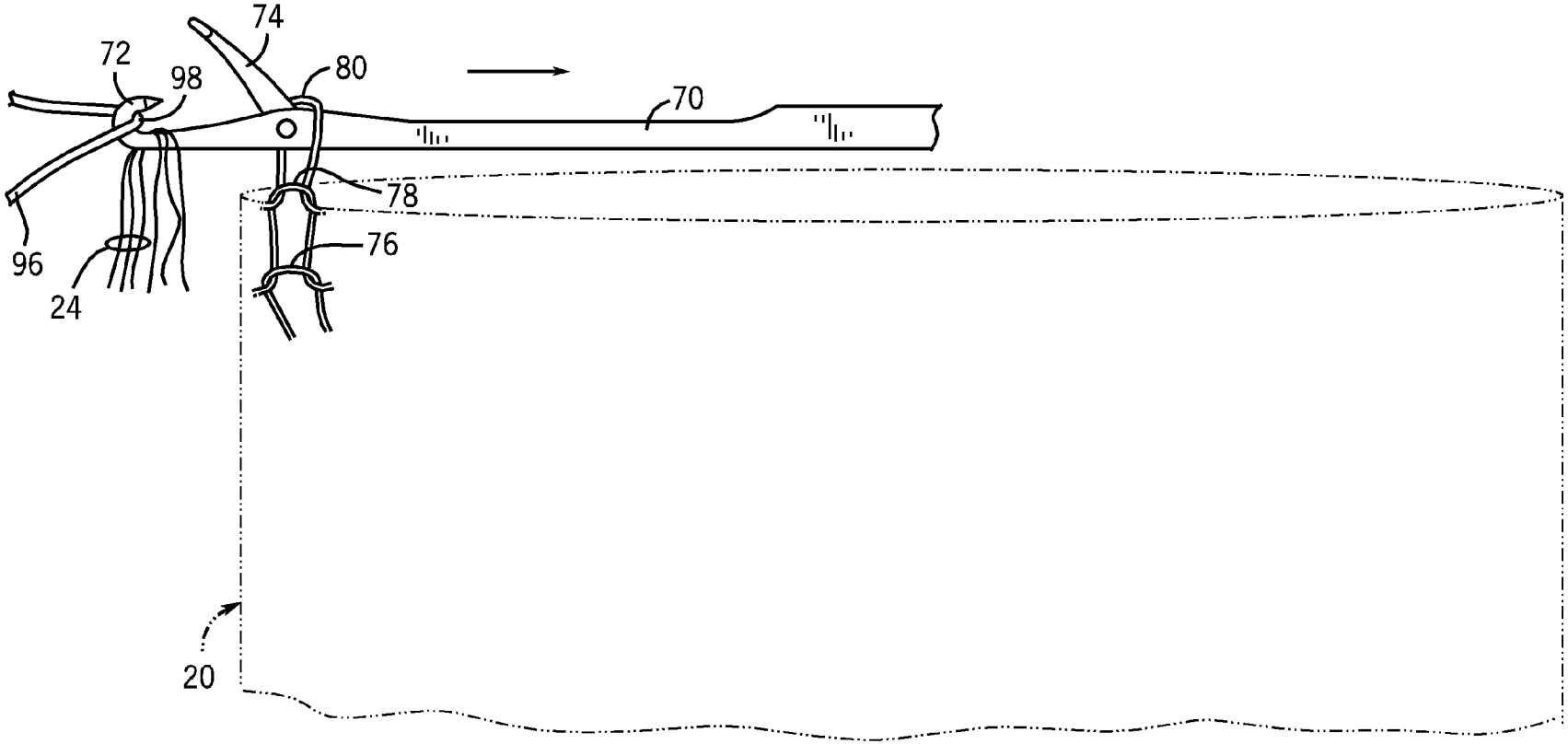
FIG. 7 is a schematic view of the knitting needle and the tubular paint roller fabric shown in FIGS. 3 through 6, with the needle moving in a proximal direction and the hook capturing the base yarn for a new loop in the vertical chain of loops, and with the latch being closed by the old loop as the needle moves in the proximal direction.

FIGS. 3 through 9 illustrate a sliver knitting process which may be used to knit the tubular sliver knit segment 20 shown in FIGS. 1 and 2. These figures show in sequential fashion how a stitch is formed. Each of these figures shows a needle 70 having a hook 72 located at the distal end thereof and a latch 74 that has a proximal end that is pivotally mounted at a location on the needle 70 that is proximal of the hook 72. The latch 74 can pivot between a closed position (shown in FIGS. 3, 8, and 9) in which the distal end of the latch 74 contacts the end of the hook 72 to form an enclosed area with the hook 72, and an opened position (shown in FIGS. 5 and 6) in which the distal end of the latch 74 forms a small acute angle with the proximal end of the needle 70. FIGS. 4 and 7 show the latch 74 in intermediate positions.

FIGS. 3 through 9 also show the tubular sliver knit segment 20 in phantom lines, with only several loops in a single wale being shown in solid lines. Specifically, sequential loops 76, 78, and 80 are shown in each of FIGS. 3 through 9, with the loops 76, 78, and 80 being in courses that are knitted sequentially from the course containing the lowest loop number to the course containing the highest loop number. The knitting process shown in FIGS. 3 through 9 shows the knitting of a new loop 98 in a new course being knit above the loop 80.

Note that in each of FIGS. 3 through 9, the needle 70 is generally located inside the tubular sliver knit segment 20 with its distal end (the end with the hook 72) extending from the interior of the tubular sliver knit segment 20 outwardly. Thus, movement of the needle 70 in a proximal direction is defined as movement radially inwardly with respect to the tubular sliver knit segment 20, and movement of the needle 70 in a distal direction is defined as movement radially outwardly with respect to the tubular sliver knit segment 20. Those skilled in the art will at once appreciate that the location, orientation, and movement of the needle 70 is radically different from the location, orientation, and movement of needles in currently known circular knitting machines. (The needles in currently known circular knitting machines are oriented essentially parallel to the axis of the tubular segment being knit, with the hooks of the needles located above the top end of the tubular segment being knit.)

Referring first to FIG. 3, the needle 70 is in its fully proximal or resting position, with the loop 80 engaged by the hook 72 of the needle 70 (near the distal-most end of the needle 70) and with the latch 74 in its closed position with the distal end of the latch 74 adjacent the distal end of the hook 72.

Referring next to FIG. 4 in contrast with FIG. 3, it may be seen that the needle 70 has moved in a distal direction, and the loop 80 has opened the latch 74 and caused the latch 74 to move to a position approximately midway between its closed and opened positions. Note that the loop 80 is adjacent the proximal end of the latch 74.

Referring now to FIG. 5 in contrast with FIG. 4, it may be seen that the needle 70 has continued to move in a distal direction, and the loop 80 is located nearly at the distal end of the latch 74 with the latch 74 remaining in the opened position. In this position, the loop 80 is about to fall off of the latch 74, although the loop 80 will remain on the needle 70.

Referring next to FIG. 6, another element of the circular knitting machine of which the needle 70 is a part is shown for the first time—a doffer roll 90 having a wire face 92. The doffer roll 90 is part of a head of the circular knitting machine, the construction and operation of which are well known to those skilled in the art. Those skilled in the art will immediately appreciate that the location and orientation of the doffer roll 90 is also radically different from the location and orientation of doffer rolls in currently known circular knitting machines. (The doffer rolls in currently known circular knitting machines are located above the hooks of the needles, which needles, as mentioned above, are oriented parallel to the axis of the tubular segment being knit, with the hooks of the needles being located above the top end of the tubular segment being knit.)

The doffer roll 90 is rotating in a clockwise direction, and it carries sliver fibers 94 in the wire face 92, the sliver fibers 94 being supplied from a sliver rope (not shown) being fed into the head (not shown) that contains the doffer roll 90 and the wire face 92. As may be seen in FIG. 6 in contrast with FIG. 5, the needle 70 has moved to its fully distal position, which places the hook 72 of the needle 70 into the wire face 92 of the doffer roll 90. The rotation of the doffer roll 90 causes some of the sliver fibers 94 in the wire face 92 to become engaged by the hook 72, forming a tuft of pile fibers 24 on the hook 72. It may also be noted that with the needle 70 in its fully distal position, the loop 80 has slipped entirely off of the latch 74, and is located on the needle 70 in a position that is proximal to the latch 74.

Referring now to FIG. 7 in contrast with FIG. 6, it may be seen that the needle 70 has begun to move in a proximal direction with the tuft of the pile fibers 24 still being located on the hook 72 of the needle 70. The hook 72 is now located away from the wire face 92 of the doffer roll 90 (not shown in FIG. 7), and the hook 72 has also engaged a yarn segment 96 and begun to form a new loop 98. As the needle 70 has moved distally, the loop 80 has moved in a proximal direction on the needle 70 and has engaged the latch 74, causing it to move from its opened position toward its closed position (it is shown in FIG. 7 as having moved slightly past its midway position).

Figure 8:
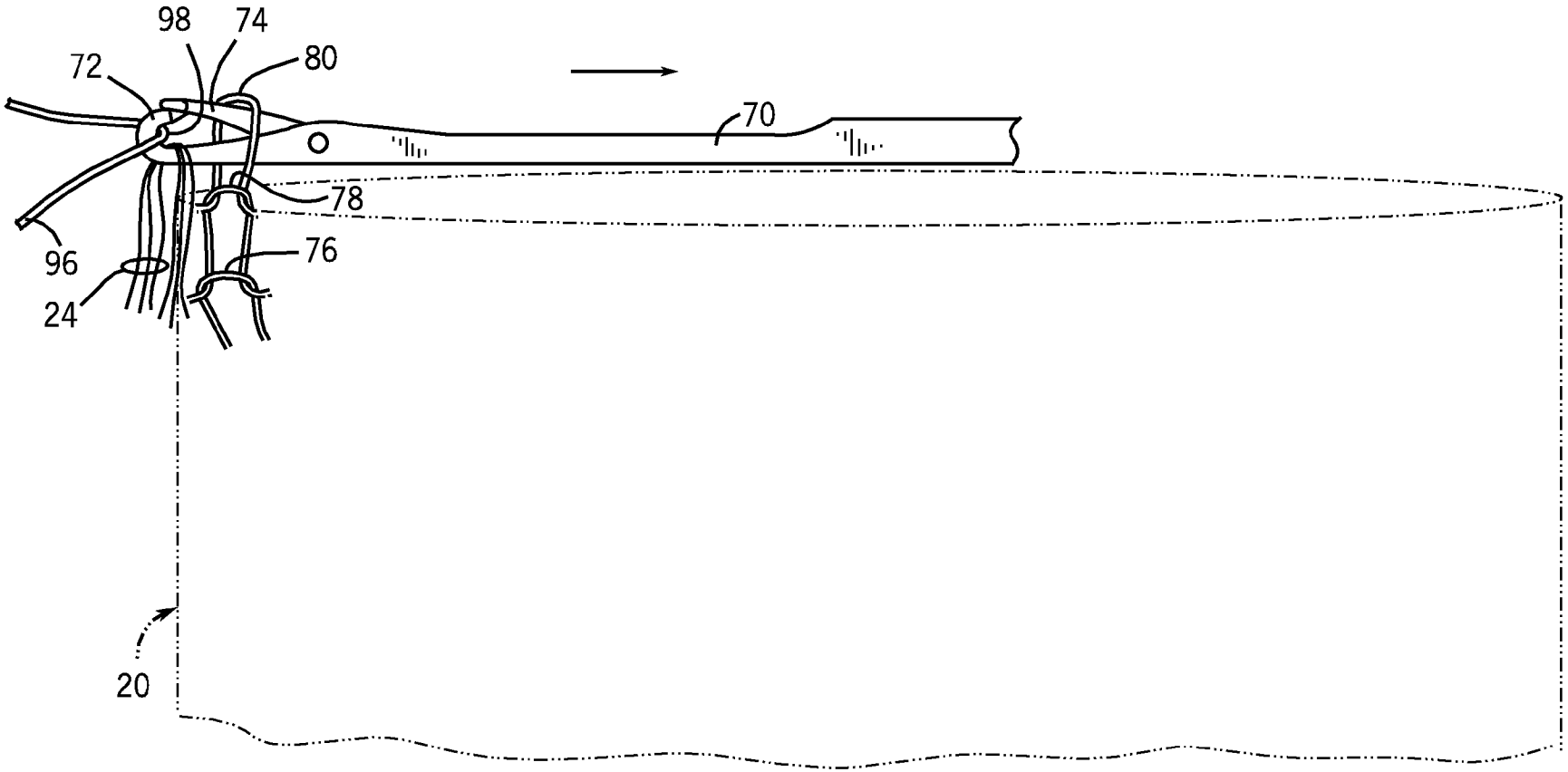
FIG. 8 is a schematic view of the knitting needle and the tubular paint roller fabric shown in FIGS. 3 through 7, with the needle continuing to move in a proximal direction and the latch being completely closed.

Referring next to FIG. 8 in contrast with FIG. 7, it may be seen that the needle 70 has continued to move in a proximal direction, with both the tuft of the pile fibers 24 and the loop 98 of the yarn segment 96 still being located on the hook 72 of the needle 70. As the needle 70 has continued to move distally, the loop 80 has moved in a proximal direction on the needle 70 and has begun to slide over the latch 74, which is now in its closed position. The fact that the latch 74 is closed also assists in retaining both the tuft of the pile fibers 24 and the loop 98 of the yarn segment 96 on the hook 72 of the needle 70.

Figure 9:
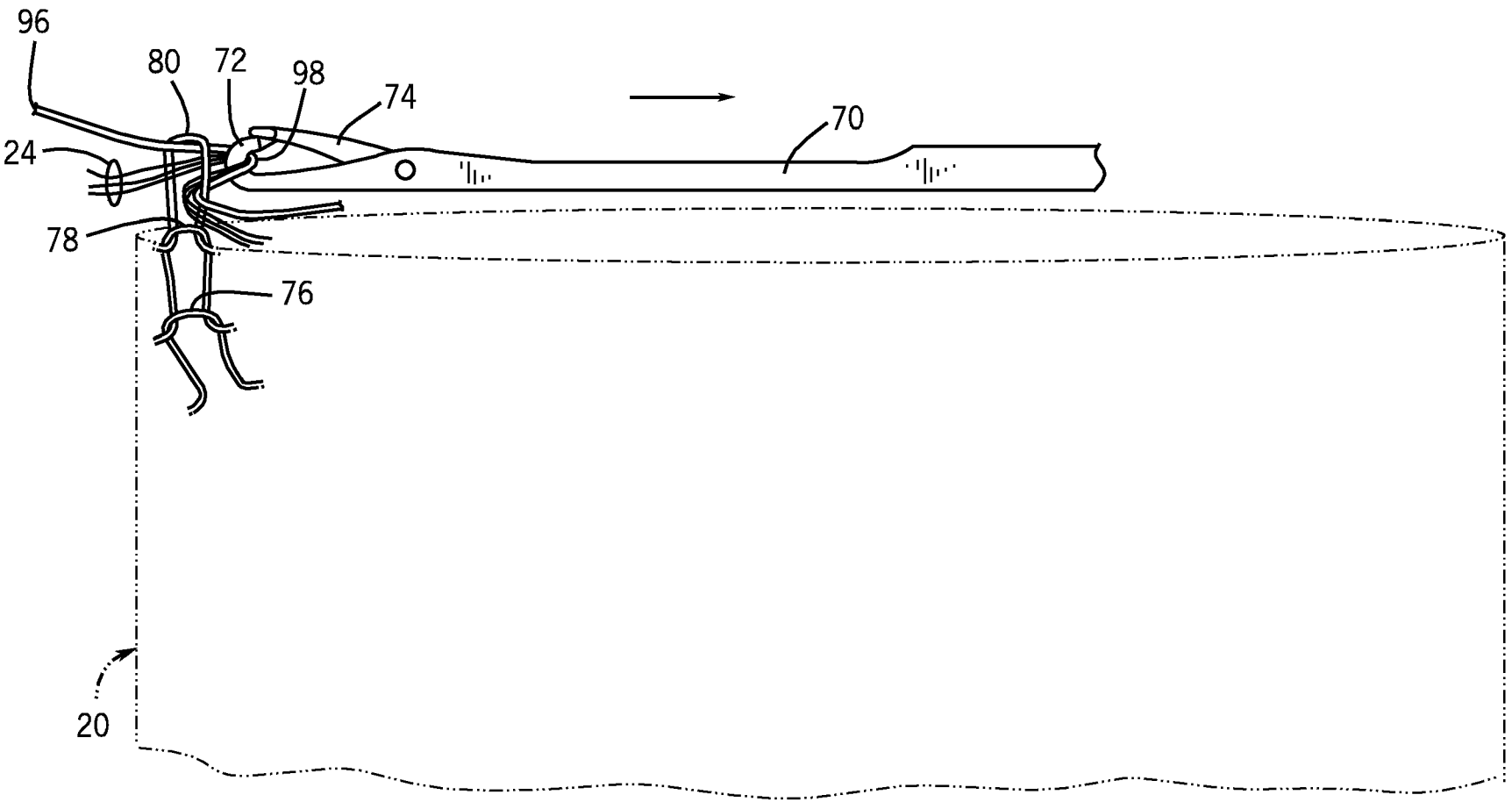
FIG. 9 is a schematic view of the knitting needle and the tubular paint roller fabric shown in FIGS. 3 through 8, with the needle in its fully proximal direction and with the old loop having been cast off and the new loop having been formed.

Referring next to FIG. 9 in contrast with FIG. 8, it may be seen that the needle 70 has moved nearly to its fully proximal or resting direction, and has pulled the loop 98 of the yarn segment 96 and the loop of the tuft of the pile fibers 24 through the loop 80. As this happened, the loop 80 slipped off of the hook 72 and the latch 74 of the needle 70; this is referred as the loop 80 having been "cast off" the needle 70. Thus, the loop 98 has been knitted through the loop 80, with the tuft of the pile fibers 24 having their midpoints adjacent the top of the loop 98, and their ends extending outwardly from the tubular sliver knit segment 20. Thus, the tubular sliver knit segment 20 is knitted with the pile fibers 24 extending outwardly.

Those skilled in the art will appreciate that while the process shown in FIGS. 3 through 9 has been depicted with only a single needle 70, a plurality of needles will be used, all located, oriented, and moving in a manner similar to that described with reference to the needle 70. In the preferred embodiment, between forty and one hundred needles will be used, with the currently preferred embodiment having approximately fifty-six needles. It will be appreciated by those skilled in the art that the number of wales produced by a circular knitting machine is the same as the number of needles used by the circular knitting machine.

A wide variety of materials may be used to knit the tubular sliver knit segment 20, and the tubular sliver knit paint roller cover fabric of the present invention may be made of virtually any of the materials used in sliver knit fabrics in the past. For example, the yarn may be made of synthetic yarns, with the pile being made of natural or synthetic fibers, or a blend of natural and synthetic fibers. Synthetic fibers used in the knit base may be, for example, polyester, acrylic, polypropylene, aramid, and spandex, or a blend of any of the aforementioned. Natural fibers used in the pile may be, for example, wool, and synthetic fibers used in the pile may be, for example, polyester, acrylic, nylon, modacrylic, rayon, polypropylene, and aramid, or a blend of any of the aforementioned. Yarn deniers between approximately seventy-five and four hundred twenty-five may be used, and fiber lengths may be between approximately three-eighths of an inch (nine and one-half millimeters) and four inches (one hundred two millimeters), although yarns and fibers outside these ranges may be useable as well.

Figures 10, 11, 12:
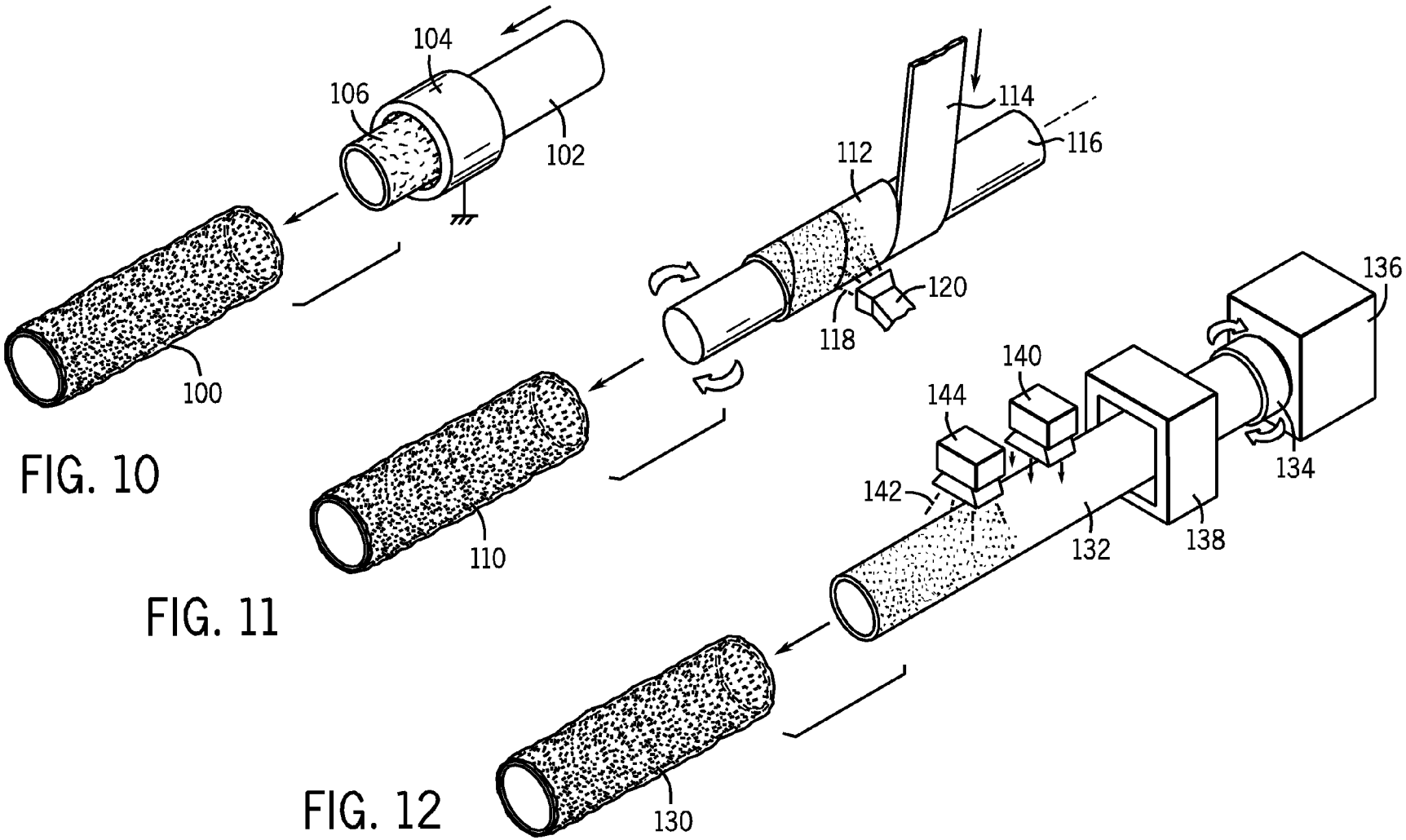
FIG. 10 is a somewhat schematic depiction of the installation of a tubular segment of the tubular paint roller fabric illustrated in FIGS. 1 and 2 onto a thermoplastic tube that has had its outer surface softened by a heater.
FIG. 11 is a schematic depiction of the installation of a tubular segment of the tubular paint roller fabric illustrated in FIGS. 1 and 2 onto a tube formed on a mandrill of a helically-wound strip of hot thermoplastic material and having glue coated on the outside thereof to secure the tubular segment of the tubular paint roller fabric thereupon.
FIG. 12 is a schematic depiction of the installation of a tubular segment of the tubular paint roller fabric illustrated in FIGS. 1 and 2 onto a tube formed by an extruder having a rotating head, the tube being plasma treated and having epoxy coated on the outside thereof to secure the tubular segment of the tubular paint roller fabric thereupon.

Moving now to FIGS. 10 through 12, several different methods of mounting a portion of the tubular sliver knit segment 20 onto paint roller cover cores are schematically illustrated. Referring first to FIG. 10, a tubular sliver knit segment 100 is to be mounted on a length of plastic tubular core stock 102 using a heat fusing technique rather than an adhesive. The plastic tubular core stock 102 may be made of polypropylene or any suitable thermoplastic material having the desired heat-bonding characteristics.

A heat source 104 is positioned to soften the outer surface of the plastic tubular core stock 102 before the tubular sliver knit segment 100 is mounted on the plastic tubular core stock 102, with the heat-softened outer surface 106 being ready to receive the tubular sliver knit segment 100. The heat source 104 may be more elongated in the direction of the axis of the plastic tubular core stock 102 than is schematically shown in FIG. 10, and may, for example, consist of a manifold-like structure for directing a series of flame jets against the surface of the plastic tubular core stock 102. Any suitable fuel may be used, such as, for example, natural gas. Alternatively, the heat source 104 may use an electrical, optical, or other type of energy source.

In this manner, the outer surface of the plastic tubular core stock 102 is heat-softened to the point that when the tubular sliver knit segment 100 is placed upon the heat-softened outer surface 106 of the plastic tubular core stock 102, the tubular sliver knit segment 100 is in effect fused onto the plastic tubular core stock 102. In this manner, the tubular sliver knit segment 100 and the plastic tubular core stock 102 become an integral unitary paint roller cover. The heat fusing will also act to retain the pile fibers on the tubular sliver knit segment 100.

It will be appreciated by those skilled in the art that the plastic tubular core stock 102 may be cut to single paint roller size (typically nine inches (two hundred twenty-nine millimeters)), or it may be cut to a longer length, such as, for example, sixty-four inches (one thousand six hundred twenty-five millimeters). If a longer length is used, following installation of the tubular sliver knit segment 100 onto the plastic tubular core stock 102, it may be cut into the desired size shorter paint roller covers, such as, for example, seven nine inch paint roller covers. Finishing the paint roller covers typically will include the steps of combing the sliver knit fabric on the paint roller cover and shearing the sliver knit fabric to the desired length. These finishing steps may occur either before or after cutting longer segments to the desired length. Finally, the edges of the paint roller covers are beveled, and any loose sliver fibers may be vacuumed off.

Referring next to FIG. 11, a tubular sliver knit segment 110 is to be mounted on a core member 112 that is manufactured by helically winding one or more strips of thermoplastic material 114 about a rotating mandrill 116. The strip(s) of thermoplastic material 114 may be made of polypropylene or any suitable thermoplastic material having the desired characteristics. The strip(s) of thermoplastic material 114 are wound together in an overlapping relation about the mandrill 116 to form the core member 112.

The strip of thermoplastic material 114 used to make the core member 112 may be bonded together by a thermoplastic material, again preferably polypropylene, that is applied to the strip of thermoplastic material 114 in liquid form, for example by sufficiently heating polypropylene to liquefy it, and then feeding it to the strips. The strip(s) of thermoplastic material 114 are rapidly bonded together to form the core member 112 as the liquid polypropylene cools and sets. Alternately, liquefied thermoplastic may be applied to a belt that transfers the rapid setting liquefied thermoplastic to the mandrill 116.

After the core member 112 is formed, an adhesive 118, which may, for example, be liquid polypropylene, is applied to the outer surface of the core member 112 by an applicator 120. The tubular sliver knit segment 110 is then placed onto the core member 112 (which may be performed by stopping rotation of the core member 112 while the tubular sliver knit segment 110 is placed onto the core member 112), and the tubular sliver knit segment 110 is bonded onto the core member 112 as the adhesive 118 sets. The adhesive 118 also acts to retain the pile fibers on the tubular sliver knit segment 110.

Following installation of the tubular sliver knit segment 110 onto the core member 112, it may be cut into the desired size shorter paint roller covers, such as, for example, nine inch paint roller covers. Finishing the paint roller covers again will include the steps of combing the sliver knit fabric on the paint roller cover and shearing the sliver knit fabric to the desired length. These finishing steps may occur either before or after cutting longer segments to the desired length. Finally, the edges of the paint roller covers are beveled, and any loose sliver fibers may be vacuumed off.

Referring finally to FIG. 12, a tubular sliver knit segment 130 is to be mounted on a plastic core member 132 that is extruded through a rotating extruder head 134 on an extruder 136. The extruder 136 receives a plastic resin, which may be polypropylene or any suitable thermoplastic material having the desired characteristics. The plastic resin melts and is extruded through the rotating extruder head 134 into the hollow cylindrical core member 132, that rotates and moves forward at a constant velocity. The core member 132 enters a vacuum sizing and cooling tank 138 where a vacuum is applied to the exterior of the core member 132 along with chilled water spray that cools the core member 132 down to a point at which full stability is achieved in the plastic material it is made of.

In the preferred embodiment, the external surface of the core member 132 is treated with high voltage electrical plasma in a surface treater 140 in order to cause the outer surface of the core member 132 to attract and accommodate adhesive. A thin layer of epoxy 142 or some other suitable adhesive is applied to the outer surface of the core member 132 by an epoxy extrusion unit 144. The epoxy 142 may be, for example, the adhesive resins sold under the trademarks MASTERGRIP 5200, 5300, or 5408, which are available from Fielco Industries of Huntingdon Valley, Pa. The tubular sliver knit segment 130 is then placed onto the core member 132 (which may be performed by stopping rotation of the core member 132 while the tubular sliver knit segment 130 is placed onto the core member 132), and the tubular sliver knit segment 130 is bonded onto the core member 132 as the epoxy 142 sets. The epoxy 142 also acts to retain the pile fibers on the tubular sliver knit segment 130.

Following installation of the tubular sliver knit segment 130 onto the core member 132, it may be cut into the desired size shorter paint roller covers, such as, for example, nine inch paint roller covers. Finishing the paint roller covers again will include the steps of combing the sliver knit fabric on the paint roller cover and shearing the sliver knit fabric to the desired length. These finishing steps may occur either before or after cutting longer segments to the desired length. Finally, the edges of the paint roller covers are beveled, and any loose sliver fibers may be vacuumed off.

It may therefore be appreciated from the above detailed description of the preferred embodiment of the present invention that it provides a tubular sliver knit paint roller cover fabric that is suitable for use in the manufacture of a paint roller cover. The tubular sliver knit paint roller cover fabric of the present invention is manufactured with the pile side facing outwardly rather than inwardly, thereby obviating the need to invert it prior to mounting it on a paint roller cover core. The tubular sliver knit paint roller cover fabric of the present invention is of a size suitable for mounting on a paint roller cover core in a seamless manner, without cutting it except for cutting it to a length fitting the length of paint roller cover core material on which the tubular sliver knit paint roller cover fabric is to be mounted.

The tubular sliver knit paint roller cover fabric of the present invention is well suitable for use in its application on a paint roller cover, and will not experience any significant degradation of the tubular sliver knit paint roller cover fabric due to its contact with a wide variety of paints, enamels, stains, etc. The tubular sliver knit paint roller cover fabric of the present invention is manufactured in a manner in which the sliver fibers are securely retained by the knit base material such that the shedding of sliver fibers from the tubular sliver knit paint roller cover fabric is minimized. The tubular sliver knit paint roller cover fabric of the present invention is also manufacturable in extended length segments that may later be cut to tubular segments of any desired length.

The tubular sliver knit paint roller cover fabric of the present invention is of a construction which is both durable and long lasting when it has been secured to a paint roller cover core, and the resulting paint roller cover will provide the user with an acceptably long lifetime. The tubular sliver knit paint roller cover fabric of the present invention is also inexpensive to manufacture, thereby enhancing its market appeal and to affording it the broadest possible market. Finally, all of the aforesaid advantages and objectives of the tubular sliver knit paint roller cover fabric of the present invention are achieved without incurring any substantial relative disadvantage.

Although the foregoing description of the tubular sliver knit paint roller cover of the present invention has been shown and described with reference to particular embodiments and applications thereof, it has been presented for purposes of illustration and description and is not intended to be exhaustive or to limit the invention to the particular embodiments and applications disclosed. It will be apparent to those having ordinary skill in the art that a number of changes, modifications, variations, or alterations to the invention as described herein may be made, none of which depart from the spirit or scope of the present invention. The particular embodiments and applications were chosen and described to provide the best illustration of the principles of the invention and its practical application to thereby enable one of ordinary skill in the art to utilize the invention in various embodiments and with various modifications as are suited to the particular use contemplated. All such changes, modifications, variations, and alterations should therefore be seen as being within the scope of the present invention as determined by the appended claims when interpreted in accordance with the breadth to which they are fairly, legally, and equitably entitled.

What is claimed is:

1. A sliver knit pile fabric suitable for use on paint roller covers, said sliver knit pile fabric comprising:

an uninverted knitted base fabric having a tubular configuration defining an outside and an inside, said base fabric having a predetermined number of wales located adjacent each other and arranged around the circumference of said base fabric, said base fabric having successive courses each of which is knit after a preceding course, said base fabric comprising a plurality of loops, wherein each loop in any particular wale is knitted through a loop in the preceding course in said particular wale from the outside to the inside of said tubular configuration of said base fabric; and a plurality of tufts of fibers, each of said tufts of fibers having opposite ends with a loop portion located therebetween, said loop portion of each of said plurality of tufts being knitted together with a loop of said base fabric into said base fabric, said opposite ends of said plurality of tufts of fibers extending outwardly from said base fabric and forming the pile of said sliver knit fabric.

2. A sliver knit pile fabric as defined in claim 1, wherein said base fabric is knitted from a yarn made of a synthetic fiber.

3. A sliver knit pile fabric as defined in claim 2, wherein said yarn is made of polyester, acrylic, polypropylene, aramid, spandex, or a blend of any of the aforementioned.

4. A sliver knit pile fabric as defined in claim 1, wherein said yarn has a denier of between seventy-five and four hundred fifty.

5. A sliver knit pile fabric as defined in claim 1, wherein said tufts of fibers are made of natural or synthetic fibers, or a blend of natural and synthetic fibers.

6. A sliver knit pile fabric as defined in claim 5, wherein said tufts of fibers are made of wool, polyester, acrylic, nylon, modacrylic, rayon, polypropylene, aramid, or a blend of any of the aforementioned.

7. A sliver knit pile fabric as defined in claim 1, wherein said tufts of fibers are between approximately three-eighths of an inch and approximately four inches in length.

8. A sliver knit pile fabric as defined in claim 1, wherein the number of wales in said tubular configuration base fabric is between approximately forty and approximately one hundred.

9. A sliver knit pile fabric as defined in claim 8, wherein the number of wales in said tubular configuration base fabric is approximately fifty-six.

10. A sliver knit pile fabric as defined in claim 1, wherein said tubular configuration base fabric has an inner diameter of approximately five inches or less.

11. A sliver knit pile fabric as defined in claim 10, wherein said tubular configuration base fabric has an inner diameter that is approximately the same size as the outer diameter of a paint roller cover core.

12. A sliver knit pile fabric as defined in claim 11, wherein said tubular configuration base fabric has an inner diameter of approximately one and one-half inches.

13. A sliver knit pile fabric as defined in claim 1, wherein said tubular configuration base fabric is manufactured in an extended length that is substantially longer than the length of a paint roller.

14. A paint roller cover made in part from a sliver knit pile fabric as defined in claim 1, said paint roller cover comprising:

a hollow cylindrical paint roller cover core; and a segment of said tubular configuration base fabric secured to the outside surface of said paint roller cover core.

15. A paint roller cover as defined in claim 14, wherein said tubular configuration base fabric is secured to the outside surface of said paint roller cover core using an adhesive.

16. A paint roller cover as defined in claim 14, wherein said tubular configuration base fabric is secured to the outside surface of said paint roller cover core using an epoxy.

17. A paint roller cover as defined in claim 14, wherein said paint roller cover core is made of a thermoplastic material, wherein said tubular configuration base fabric is secured to the outside surface of said paint roller cover core by heating the outer surface of said paint roller cover core and placing said segment of said tubular configuration base fabric on the outside surface of said paint roller cover core, whereby said segment of said tubular configuration base fabric is heat fused to the outside surface of said paint roller cover core.

18. A paint roller cover as defined in claim 14, wherein said tubular configuration base fabric is combed and sheared to the desired length after said segment of said tubular configuration base fabric is secured to the outside surface of said paint roller cover core.

19. A paint roller cover as defined in claim 18, wherein said tubular configuration base fabric is also beveled and vacuumed after said segment of said tubular configuration base fabric is secured to the outside surface of said paint roller cover core.

20. A sliver knit pile fabric suitable for use on paint roller covers, said sliver knit pile fabric comprising:

an univerted knitted base fabric having a tubular configuration defining an outside and an inside, said base fabric having wales located adjacent each other and arranged around the circumference of said base fabric, said base fabric also having successive courses each of which is knit after a preceding course, said base fabric comprising a plurality of loops, wherein each loop in any particular wale is knitted through a loop in the preceding course in said particular wale; and a plurality of tufts of fibers, each of said tufts of fibers being knitted together with a loop of said base fabric into said base fabric with the ends of said of tufts of fibers extending outwardly from said base fabric and forming the pile of said sliver knit fabric.

21. A sliver knit pile fabric suitable for use on paint roller covers, said sliver knit pile fabric comprising:

a knitted base fabric having a tubular configuration defining an outside and an inside, said base fabric having between forty and one hundred wales located adjacent each other and arranged around the circumference of said base fabric, said base fabric having successive courses each of which is knit after a preceding course, said base fabric comprising a plurality of loops, wherein each loop in any particular wale is knitted through a loop in the preceding course in said particular wale from the outside to the inside of said tubular configuration of said base fabric;

wherein said tubular configuration base fabric has an inner diameter that is approximately the same size as the outer diameter of a paint roller cover core; and a plurality of tufts of fibers, each of said tufts of fibers having opposite ends with a loop portion located therebetween, said loop portion of each of said plurality of tufts being knitted together with a loop of said base fabric into said base fabric, said opposite ends of said plurality of tufts of fibers extending outwardly from said base fabric and forming the pile of said sliver knit fabric, wherein said tufts of fibers are between approximately three-eighths of an inch and approximately four inches in length.

22. A method of making a sliver knit pile fabric comprising:

knitting a base fabric in a tubular configuration defining an outside and an inside, said base fabric having a predetermined number of wales located adjacent each other and arranged around the circumference of said base fabric, said base fabric having successive courses each of which is knit after a preceding course, said base fabric comprising a plurality of loops, wherein each loop in any particular wale is knitted through a loop in the preceding course in said particular wale from the outside to the inside of said tubular configuration of said base fabric;

providing a plurality of tufts of fibers, each of said tufts of fibers having opposite ends with a loop portion located therebetween; and knitting said loop portion of each of said plurality of tufts together with a loop of said base fabric into said base fabric, said opposite ends of said plurality of tufts of fibers extending outwardly from said base fabric and forming the pile of said sliver knit fabric.

23. A method as defined in claim 22, wherein said base fabric is knitted from a yarn made of a synthetic fiber.

24. A method as defined in claim 23, wherein said yarn is made of polyester, acrylic, polypropylene, aramid, spandex, or a blend of any of the aforementioned.

25. A method as defined in claim 22, wherein said yarn has a denier of between seventy-five and four hundred fifty.

26. A method as defined in claim 22, wherein said tufts of fibers are made of natural or synthetic fibers, or a blend of natural and synthetic fibers.

27. A method as defined in claim 26, wherein said tufts of fibers are made of wool, polyester, acrylic, nylon, modacrylic, rayon, polypropylene, aramid, or a blend of any of the aforementioned.

28. A method as defined in claim 22, wherein said tufts of fibers are between approximately three-eighths of an inch and approximately four inches in length.

29. A method as defined in claim 22, wherein the number of wales in said tubular configuration base fabric is between approximately forty and approximately one hundred.

30. A method as defined in claim 29, wherein the number of wales in said tubular configuration base fabric is approximately fifty-six.

31. A method as defined in claim 22, wherein said tubular configuration base fabric has an inner diameter of approximately five inches or less.

32. A method as defined in claim 31, wherein said tubular configuration base fabric has an inner diameter that is approximately the same size as the outer diameter of a paint roller cover core.

33. A method as defined in claim 32, wherein said tubular configuration base fabric has an inner diameter of approximately one and one-half inches.

34. A method as defined in claim 22, wherein said tubular configuration base fabric is manufactured in an extended length that is substantially longer than the length of a paint roller.

35. A silver knit pile fabric suitable for use on paint roller covers that is manufactured according to the method as defined in claim 22.

36. A silver knit pile fabric suitable for use on paint roller covers, said silver knit pile fabric comprising:

a knitted base fabric having a tubular configuration defining an outside and an inside, said base fabric having a predetermined number of wales located adjacent each other and arranged around the circumference of said base fabric, said base fabric having successive courses each of which is knit after a preceding course, said base fabric comprising a plurality of loops, wherein each loop in any particular wale is knitted through a loop in the preceding course in said particular wale from the outside to the inside of said tubular configuration of said base fabric; and a plurality of tufts of fibers, each of said tufts of fibers having opposite ends with a loop portion located therebetween, said loop portion of each of said plurality of tufts being knitted together with a loop of said base fabric into said base fabric, said opposite ends of said plurality of tufts of fibers extending outwardly from said base fabric and forming the pile of said silver knit fabric;

wherein said kintted base fabric is of an extended length that is sufficiently long to effectively preclude its inversion.

* * * * *